US010421914B2

(12) United States Patent
Ledo Perez

(10) Patent No.: US 10,421,914 B2
(45) Date of Patent: Sep. 24, 2019

(54) SOLID RESIDUE SEPARATION: A NEW WAY OF TRANSPORTING AND PROCESSING HEAVY FEEDSTOCKS

(71) Applicant: David Ledo Perez, Calgary (CA)

(72) Inventor: David Ledo Perez, Calgary (CA)

(73) Assignee: David Ledo Perez, Calgary, Alberta (CA)

( * ) Notice: Subject to any disclaimer, the term of this patent is extended or adjusted under 35 U.S.C. 154(b) by 198 days.

(21) Appl. No.: 15/062,111

(22) Filed: Mar. 6, 2016

(65) Prior Publication Data

US 2017/0253809 A1 Sep. 7, 2017

(51) Int. Cl.

| | |
|---|---|
| ***C10G 7/06*** | (2006.01) |
| ***C10G 1/02*** | (2006.01) |
| ***C10G 7/00*** | (2006.01) |
| ***C10G 1/00*** | (2006.01) |
| ***C10G 9/00*** | (2006.01) |

(52) U.S. Cl.

CPC ..... *C10G 7/06* (2013.01); *C10G 1/002* (2013.01); *C10G 1/02* (2013.01); *C10G 7/00* (2013.01); *C10G 9/005* (2013.01)

(58) Field of Classification Search

USPC ..... 201/30; 208/131

See application file for complete search history.

(56) References Cited

U.S. PATENT DOCUMENTS 2,844,524 A * 7/1958 Ernst, Jr. ..... C10G 9/32 208/92
2,850,436 A * 9/1958 Beuther ..... C10C 3/06 208/103
2,944,958 A 7/1960 Goldhwait
4,308,128 A * 12/1981 Cummings ..... B01J 8/1836 208/100

(Continued)

FOREIGN PATENT DOCUMENTS

CA 2819073 A1 * 10/2014

OTHER PUBLICATIONS

"A review of technologies for transporting heavy crude oil and bitumen via pipelines", Hart , SpringerLink, Production Enginering , Online date Oct. 22, 2013.*

(Continued)

*Primary Examiner* — Nina Bhat

(57) ABSTRACT

A method comprising a combination and sequential methods to: a.-)Produce solid vacuum residue, b.-) Melt the solid vacuum residue, and c.-)Heat the melted Solid Vacuum residue. This invention applies to any single or mixture of hydrocarbons including one or more heavy crude oils, extra heavy crude oils, tar sands and/or bitumens, (named heavy feedstocks). The heavy feedstock is processed in the production field or a nearby location using atmospheric, vacuum distillation and a solid forming unit, to produce liquid distillates and a solid vacuum residue resulting from a deep cut point of the heavy vacuum gasoil. The Solid Vacuum Residue is melted and heated at the destination to (Continued)

Solid Residue Separation Manufacturing Block Flow Diagram using Atmospheric Section, Vacuum Distillation and Solid Forming be used as feedstocks in refineries deep conversion units to optimize operations and economics.This invention reduces the diluent imports at the heavy feedstocks production fields used for its production and/or its transportation.

7 Claims, 1 Drawing Sheet

(56) References Cited

U.S. PATENT DOCUMENTS

| | | | | |
|---|---|---|---|---|
| 4,592,830 | A * | 6/1986 | Howell | C10G 9/007 196/100 |
| 9,637,685 | B2 * | 5/2017 | Mattingly | C10G 1/00 |
| 2004/0035749 | A1 * | 2/2004 | Khan | C10G 31/00 208/106 |
| 2006/0006101 | A1 * | 1/2006 | Eppig | C10B 55/00 208/131 |
| 2010/0122641 | A1 * | 5/2010 | Molaro | B61D 5/00 105/358 |
| 2012/0193093 | A1 * | 8/2012 | James | E21B 43/2406 166/267 |
| 2013/0081325 | A1 * | 4/2013 | Corscadden | C10G 67/049 44/268 |
| 2013/0303809 | A1 * | 11/2013 | Mattingly | C10G 1/00 585/13 |
| 2014/0318629 | A1 * | 10/2014 | Gieskes | B61D 5/008 137/1 |
| 2014/0350132 | A1 * | 11/2014 | Steve | C10G 2/40 518/703 |
| 2015/0038599 | A1 * | 2/2015 | Kresnyak | C01B 21/087 518/702 |
| 2016/0108324 | A1 * | 4/2016 | Johnsen | C10G 9/007 166/267 |
| 2017/0008537 | A1 * | 1/2017 | Hoffman | B61D 5/04 |

OTHER PUBLICATIONS

Richard F. Meyer, Emil D. Attanasi, Phillip A Freeman.Heavy Oil and Natural Bitumen Resources in Geological Basin of the World. Open File Report 2007-1084 U.S Depart of Interio.

Canadian Association of Petroleum Producers. Canada Oil Sands Overview and Bitumen Blender Primer. CAAP Presentation to the U.S National Academy of Science Oct. 23, 2012.

Greg Molaro. Pipeline by Rail Challenging the Myths. Altex Energy presentation. Calgary Alberta Apr. 8-9, 2014.

Alberta Royalty Review. Oil Sands Economics and Royalty Series. Appendix A Technical Report OS#1 Markets and Pricig for Alberta Bitumen Production.

Fractal System. Creating Value and Efficiency for Heavy Oil Resources. Fractal Systems Corporate Presentation Jun. 2013.

Abarasi Hart. A Review of Technologies for transporting heavy crude oil and bitumen via pipelines. Springerlink.com Published online Oct. 22, 2013.

Alberto Delbianco, Romolo Montanari. Emerging Technologies for the conversion of residues. Encyclopaedia of Hydrocarbons. By Alberto Detbianco EniTechnologie San Donato Milan.

Luis C. Castaneda, Jose A.D. Munoz Jorge Ancheyta. Current Situation of emerging technologies for upgrading heavy oils. Catalysis today. Published by Elsevier B.V.

Harold Beuther, Richard G. Goldhwait. Manufacture and use of Petroleum Pitchl&EC Product Research and dDevelopment vol. 2 No. 1 Mar. 1963. Gulf Research and Development.

IHS Energy Crude by Rail The new logistics of tight oil and oil sands growth. Special Report Canadian Oil Sands Dialogue Dec. 2014.

Jacobs Consultancy. Technology Opportunities to Improve the Competitiveness of alberta Oil Sands for U.S Refineries. Energy and Environmental Solutions Oct. 2012.

Vasant Patel, Rashid Iqbal, Odette Eng, Anand Subramanian Economc Botton of the Barrel Processing to Mimimize Fuel Oil Production. Kellogg Brown & Root Inc Houston Oct. 2008.

Phil Hunt. Focus on Slurry Hydrocracker UniflexProcess. UOP Presentation Russia and CIS BBTC 2015.

G.R. Martin, J.R. Lines. Understanding Vacuum System Fundamentals. Process Consulting Services and Graham Manufacturing CO INC Glitsch Inc Hydrocarbon Processing Oct. 1994.

* cited by examiner

Solid Residue Separation Manufacturing Block Flow Diagram using Atmospheric Section, Vacuum Distillation and Solid Forming
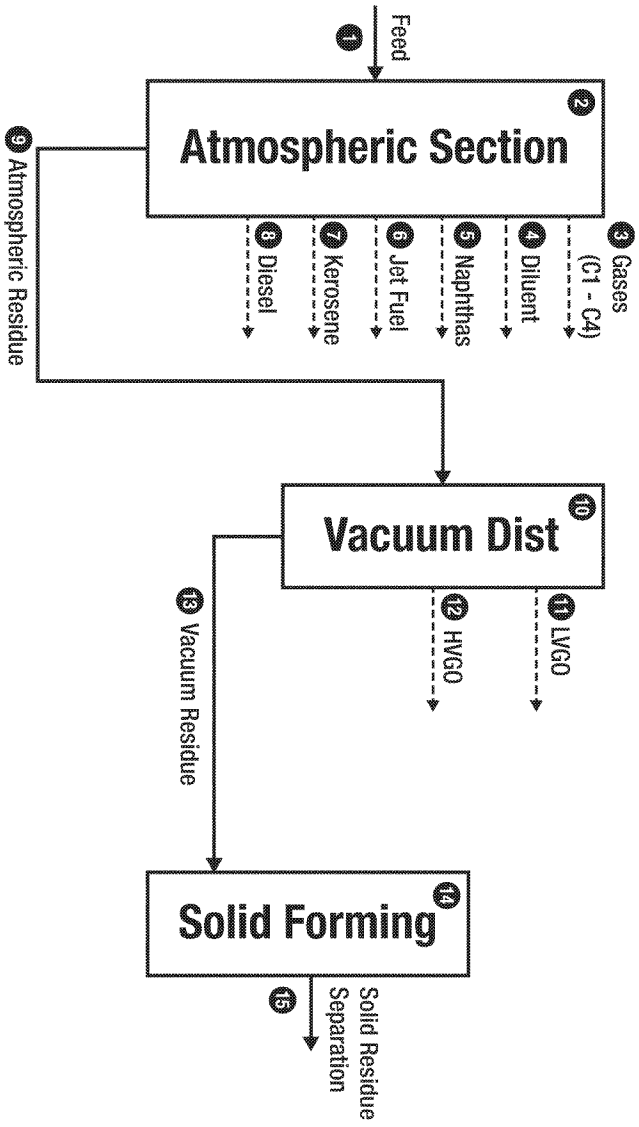

SOLID RESIDUE SEPARATION: A NEW WAY OF TRANSPORTING AND PROCESSING HEAVY FEEDSTOCKS

BACKGROUND

Production and/or reserves of heavy crude oils, extra heavy crude oils, oil sands and/or bitumens, have been growing during the years in countries such as Canada, Colombia, Venezuela, Kuwait, and Russia. In this document, the heavy crude oils, extra heavy crude oils, oil sands and/or bitumens, are referred to, collectively or individually, as Heavy Feedstocks.

Regardless of the method used to produce heavy feedstocks, in most of the cases, there is a need to blend diluent (lighter hydrocarbon(s)) with the heavy feedstocks for treatment and transportation. In this document, the blend between diluent and heavy feedstocks, will be referred to as the blend (which includes blends such as dilbit, synbit, railbit, etc.

Once the blend meets the required specifications, it is ready for commercialization. However, the transportation of the blend to the market is expensive because the diluent has to be purchased and transported from its source to the oil fields, and then transported as part of the blend to the destination. All the cost involved in this process plus any price differential is referred to as diluent cost .

One option to eliminate or reduce the diluent cost, is upgrading the heavy feedstocks to produce a high quality synthetic crude oil, and recovering and returning the diluent to the oil field. However, building an upgrader has been difficult to justify lately due to the high capital investment, long execution time and its economic feasibility.

For transportation, the heavy feedstocks, generally require an adjustment on quality to increase the API gravity and reduce the viscosity. The options used today to adjust (if needed) the qualities of the heavy feedstocks include:

- Using Diluent as a blendstock to blend it with the heavy feedstocks and meet the product specifications established to transport the blend via pipelines, trucks, rail cars, barges and/or ships. Despite the high transportation cost, it is the most popular option to date due to its ease of execution and cost. There are some existing technologies and others under study and development to reduce the diluent cost for transportation of heavy feedstocks via pipelines such as JetShear™ Technology and other technologies for bitumen transportation.
- Upgrading the heavy feedstocks trough deep conversion units (i.e. delayed coker, fluidcoker, LC Fining, H-Oil, Uniflex, HDH, etc.) to obtain a product known as Syncrude, which can be transported via pipelines trucks, railcars, barges and or ships. This option is expensive and economically unfeasible at today's oil prices, yet it has to be monitored continuosly due to the benefits it can provide at high differential prices between light crude oil and the heavy feedstocks. There are several commercial technologies already in operation and others under development to upgrade the heavy feedstocks.
- Reduction of the diluent content as blendstock, to reduce the volume of diluent to be transported to the markets and the volume of diluent imported. The blend with lower volume of diluent has been used in few cases to transport the heavy feedstocks from Canada to the U.S.A using heated railcars. This is referred to as railbit. Given the product viscosity it cannot be transported via pipelines. Consequently, this option is more expensive than the first option above, and as of today there are not enough infrastructures to handle this type of product.

In Canada, the transportation of raw product (without or with minimum diluent) by rail is under consideration to compete in cost with the transportation via pipeline of the blend. However, the problem is that this option requires building a lot more infrastructure than the railbit case, and testing is needed to confirm its viability before it could be commercially used .

Given these alternatives, it becomes clear that the transport of the blend creates the following problems:

1. High transportation cost because of the diluent cost
2. Apportionment of the pipelines due to the high volumes needed to be transported
3. Refinery limitations to process the blend and heavy feedstocks price reductions, affecting the production companies To remedy the apportionment of the pipelines, the oil production companies decided to use railcars. This alternative increases transportation cost and require new investments to build infrastructure such as railcars, loading and unloading terminals, etc.

In addition to the high transportation cost of the blend, the high content of light products (diluent) causes difficulties in the atmospheric towers of the refineries due to the handling of high volumes of light hydrocarbons. Furthermore, the diluent recovered in the refineries results in a surplus product that the majority of the refineries do not need.

As a result of these restrictions, there is a need to find a solution to reduce the volume of the blend (by reduction or elimination of diluent), to reduce transportation cost, allow the refiners to maximize processing of heavy feedstocks and reduce the pressure on the producers for additional price discount.

Unfortunately, none of the transportation options currently in use or under development resolve economically (at today's crude oil prices) the problems of: (1) importing diluent, (2) decreasing transportation cost, (3) allowing optimization of the refineries, and in some cases (4) reaching new markets (due to limited infrastructure). To mitigate these problems, we propose what we refer to as Solid Residue Separation, which additionally adds new benefits in the supply chain of hydrocarbons Any heavy feedstock can produce a vacuum residue which behaves as a solid without sticking or clumping during manufacturing, storage and transportation.

Depending of the characteristics of the heavy feedstocks, the temperature in which each particular vacuum residue behaves as a solid can vary and it can be within a range from the lowest temperature in earth up to temperatures close to 100 degrees centigrade. Then, for each heavy feedstock selected is necessary to determine the temperature that produce a Solid Residue Separation with a solid behavior.

Ideally, the heavy feedstock will produce a Solid Residue Separation, which maintains the solid behavior at a maximum temperature that can be encountered at: (a) the origin where the product is manufactured; (b) the intermediate or final destination where the product is further processed and/or blended; (c) any location where the product is stored; and (d) the temperatures and conditions in the transportation route. It is recommended to add a reasonable safety factor in the temperature at each location to assure the behavior of the Solid Residue Separation as a solid in any weather condition. This would, for instance, foster better opportunities during the winter months in some cases, as more volume of diluent is saved and also a lower temperature is needed for the Solid Residue Separation to behave as a solid. Conversely, during the summer months lower diluent volumes savings will be achieved and the required temperature for the product to ensure it behaves as solid will be higher.

Also depending of the crude oil prices, the producer can choose to export only the liquid material and store the Solid Residue Separation until the economics are favorable to export it.

If the quality of the Solid Residue Separation produced, behaves as a solid at the origin of manufacturing during all year round, but during some months of the year the temperature of the product to behave as solid is lower than the temperatures of the transportation and/or storage at the final destination, the manufacturer can store the Solid Residue Separation produced during these months of the year and sell it later when the conditions and economics are appropriate.

To produce the Solid Residue Separation, a heavy vacuum gasoil with a deep cut point (without cracking the material) should be produced in the vacuum distillation tower .

To determine if a specific crude oil, oil sand or bitumen could produce Solid Residue Separation that behave as solid at a specific temperature, laboratory tests are required to determine properties as the softening point, penetration, etc. For example if the value of the softening point is high enough i.e., having a softening point between 60 degrees to 200° C. (greater or equal to 60 degrees Centigrade at a TBP cut point of 530 degrees Centigrade or above i.e., 530-620° C.), and/or the penetration at 25 degrees centigrade of the product with a TBP cut point of 530 degrees Centigrade or above, is lower than 40 (mm/10), then the heavy crude oil, extra heavy crude oil, bitumen and/or oil sand has a potential to be used as a source of Solid Residue Separation.

Additional laboratory analysis should include test of the behavior of the product at different temperatures and conditions to determine if the product works satisfactorily at a desired temperature.

After a thorough search of articles, papers and patents related with the production of solid hydrocarbons, information about their manufacturing for use in cement kilns, the steel industry and in the utility industries, were found.

However, production of Solid Residue Separation as a solution to lower the transportation cost of Heavy Feedstocks, the elimination or reduction of diluent imports, its processing in refineries and/or its blending with other hydrocarbons, could not be found anywhere.

As an example of the above statement, in a study prepared by Jacobs Consultancy for Alberta Innovates—Energy and Environmental and published in October 2012, a panel of expert proposed 55 ideas during a brainstorm session and no one mentioned into this set of ideas the possibility to produce Solid Residue Separation or equivalent.

BRIEF SUMMARY OF THE INVENTION

The Solid Residue Separation is a new way of manufacturing, processing and transporting hydrocarbons based on the qualities of the streams that allow optimization of the hydrocarbons supply chain by: (A) a new sequential line up of process units to produce liquid product(s) and a solid hydrocarbon product(s): "The Solid Residue Separation"; (B) Storage at the production site and/or transport to the final or intermediate destination solid vacuum residue via railcars, trucks, barges and/or ships to storage areas, terminal(s) and/or refineries; and (C) the processing and/or a blending of Solid Residue Separation by melting and heating it (them) at the final destination(s) (i.e. storage areas, terminals and/or refineries) and feeding it directly to a vacuum distillation tower and/or to a deep conversion unit (i.e. delayed coker, fluidcoker, LC Fining, H-Oil, HDH, Uniflex, etc.) and/or direct it (them) to blending.

BRIEF DESCRIPTION OF THE DRAWING

The FIG. 1 is a simple block flow diagram showing the manufacturing of Solid Residue Separation. Heavy Feedstocks are fed to the atmospheric distillation section where diluent is recovered and generally send back to the heavy feedstocks production fields. The atmospheric bottom is sent to the Vacuum distillation unit to extract the maximum possible volume of distillates by a deep cut point of the heavy vacuum gasoil. The vacuum bottom is sent to a solid forming unit where the Solid Residue Separation is obtained and send to the markets for melting and heating to be processed in crude oil refineries and or blended with any other hydrocarbon(s) in storage areas, terminals and/or refineries. The distillates from the atmospheric tower as well as the light and heavy vacuum gasoils from the vacuum tower can be sold to be processed separately or as a blend (similar type of syncrude), in process units, upgraders, terminals and/or refineries

DESCRIPTION

The Solid Residue Separation is a new way of manufacturing, processing and transporting hydrocarbons based on the qualities of the streams that allow optimization of the hydrocarbons supply chain by: (A) a new sequential line up of process units to produce liquid product(s) and a solid hydrocarbon product(s): "The Solid Residue Separation"; (B) Storage at the production site and/or transport to the final or intermediate destination solid vacuum residue via railcars, trucks, barges and/or ships to storage areas, terminal(s) and/or refineries; and(C) the processing and/or a blending of Solid Residue Separation by melting and heating it (them) at the final destination(s) (i.e. storage areas, terminals and/or refineries) and feeding it directly to a vacuum distillation tower and/or to a deep conversion unit (i.e. delayed coker, fluidcoker, LC Fining, H-Oil, HDH, Uniflex, etc.) and/or direct it (them) to blending.

The Solid Residue Separation can be produced in new facilities or by modifying existing facilities.

The solution can be applied to any single or mixture of hydrocarbons that includes one or more heavy crude oils, extra heavy crude oils, oil sands and/or bitumens.

Each heavy crude oil, extra heavy crude oils, oil sands and/or bitumens, produce different qualities of Solid Residue Separation. Laboratory analysis has to be carried out to determine the temperature in which the Solid Residue Separation produced will behave as a solid (without sticking or clumping).

To produce the Solid Residue Separation (see FIG. 1), a single or a mixture of hydrocarbons that includes one or more heavy crude oils, extra heavy crude oils, oil sands and/or bitumens are fed (1) into an atmospheric distillation section (2) that can contain if needed a diluent recovery unit.

From this atmospheric section several distillates streams are obtained varying in quality and volume depending on the feed, from gases (3), diluent (4), naphthas (5), jet fuel (6), kerosene (7), diesel (8) and an atmospheric residue (9).

The stream called diluent (4) is a stream normally used to dilute heavy crude oils, extra heavy crude oils, oil sands and/or bitumens and it normally is returned to the production field(s) to be blended with the heavy crude oils, extra heavy crude oils, oil sand and/or bitumens for treatment, and transportation.

From the atmospheric section (2), the atmospheric residue (9) is sent to a vacuum distillation tower (10), to produce light (11) and heavy (12) vacuum gasoil as distillate streams and a vacuum residue (13).

The vacuum distillation tower (10) should be designed and operated to extract the maximum distillates from the atmospheric residue, removing as much as possible the distillates from the vacuum residue (13) which is sent to a solid forming unit (14) to produce a Solid Residue Separation (15) suitable for loading, transportation and storage at the highest temperature at the manufacturing site as well as at temperatures at the destination(s) (including temperatures in the transportation route), without sticking or clumping.

The maximum extraction of distillates is done by producing a Heavy Vacuum Gasoil (12) with a "deep cut" without cracking it. The "deep cut" operation is considered to commence when higher cut points than 530 degrees centigrade are implemented .

The liquid streams (distillates) from the atmospheric section (2) and the light (11) and heavy (12) vacuum gasoil from the vacuum distillation tower (10) are sent individually or as a mixture to the export markets or for further processing and blending as required to produce a variety of products. Transportation of these liquid streams is by trucks, pipeline, rail cars, barges and ships/tankers. In case any distillate stream or the blend of streams does not comply with transportation specification, a blend with synthetic crude oil or other hydrocarbon(s) can be done to meet the specifications and obtain the expected benefits.

At the final destination (storage areas, terminal(s) and/or refineries), the Solid Residue Separation (15) could be liquefied and fed to a vacuum distillation tower and/or to a deep conversion unit (delayed coker, fluidcoker, LC Fining, H-Oil,Uniflex, etc.) or used in blends.

If the selected option is to feed the Solid Residue Separation (15) to a vacuum distillation unit in a refinery, it is recommended to maximize as much as possible the volume of the liquefied Solid Residue Separation as a quench in order to free distillation capacity to optimize the processing of crude oils in the Refinery.

REFERENCES (1) "*Heavy Oil and Natural Bitumen Resources in Geological Basins of the World*". Open File -Report 2007-1084. U.S. Department of the Interior U.S. Geological Survey by Richard F. Meyer, Emil D. Attanasi, and Philip A. Freeman.

(2) *Canada Oil Sands Overview and Bitumen Blending Primer*. CAPP Presentation to the US National Academy of Science. Oct. 23, 2012

(3) "*Altex energy: Pipeline by Rail Challenging the Myths*" Presentation by Greg Molaro VP Operations Crude-by-Rail Calgary, AB Apr. 8-9, 2014.

(4) "*Alberta Royalty Review* 2007. *Oil Sands Economics and Royalty Series*". Appendix "A" Technical Report OS#1 Markets and Pricing for Alberta Bitumen Production.

(5) "*Creating value and efficiency for heavy oil resources*". Fractal Systems. Corporate Presentation June 2013.

(6) "*A review of technologies for transporting heavy crude oil and bitumen via pipelines*" by Abarasi Hart. Article published by Springerlink.com. Published online: 22 Oct. 2013.

(7) "*Emerging technologies for the conversion of residues*" . Encyclopaedia of Hydrocarbons Emerging Technologies for the conversion of Residues by Alberto Delbianco EniTecnologie San Donato Milanese, Milano, Italy and Romolo Montanari Snamprogetti San Donato Milanese, Milano, Italy.

(8) "*Current situation of emerging technologies for upgrading of heavy oils*" by Luis C. Castaneda, José A. D. Munoz, Jorge Ancheyta. Catalysis Today Published in 2013 by Elsevier B. V.

(9) U.S Pat. No. 2,850,436 "Method for the Preparation of Solid Petroleum" by Goldthwait Richard G, Harold Beuther. Publication date: Sep. 02, 1958

(10) U.S Pat. No. 2,944,958 "Process of Making Pitch" by Goldthwait Richard G, Lehrian William R. Publication date Jul. 10, 1960

(11) "*Manufacture and Use of Petroleum Pitch*" I & E C Product Research and Development Vol 2 NO. 1 March 1963 by Harold Beuther and Richard G Goldthwait—Gulf Research and Development.

(12) "*IHS Energy Crude by Rail, The new logistics of tight oil and oil sands growth*" . SPECIAL REPORT Canadian Oil Sands Dialogue. December 2014

(13) "*Technology Opportunities to Improve the Competitiveness of Alberta's Oil Sands for U.S. Refineries*". Jacobs Consultancy Prepared For Alberta Innovates—Energy and Environmental Solutions October 2012.

(14) "*Economic Bottom of the Barrel Processing To Minimize Fuel Oil Production*" by Vasant Patel, Rashid Iqbal, Odette Eng, Anand Subramanian Kellogg Brown & Root, Inc. Houston, Texas USA. October 2008

(15) "*Focus on Slurry Hydrocracker Uniflex Process*" UOP Presentation by Phil Hunt. Russia & CIS BBTC 2015.

(16) "United States Patent and Trademark office". www.uspto.gov.

(17) "Canadian Patent database". www.ic.gc.ca/opic-cipo/cpd/eng/introduction.html

(18) "*Understand Vacuum-System Fundamentals*" by G. R. MARTIN, PROCESS CONSULTING SERVICES, J. R. LINES, GRAHAM MANUFACTURING CO., INC., S. W. GOLDEN, Glitsch, Inc. Hydrocarbon Processing, October 1994

What is claimed is:

1. An improved method for optimizing the transportation and processing in refineries of heavy feedstocks, comprising:

a. providing a stream of heavy feedstocks selected from the group consisting of: heavy crude oils, extra heavy crude oils, oil sands and/or bitumens, b. separating heavy feedstocks in fractions from lighter to heavier by introducing the heavy feedstocks as a feed to an atmospheric distillation unit followed by a vacuum distillation unit, c. producing a vacuum residue in the vacuum distillation tower with a TBP temperature at start distillation higher than about 530° C., d. cooling said sold forming vacuum residue to produce a solid residue separation product having a softening point of about 60° C. or higher suitable for loading, unloading, transporting and storage of said product without sticking or clumping;

e. optimizing the refineries economics and the refineries operations by processing solid residue separation.

2. The method of claim 1, wherein the vacuum residue of step (c) is not further treated, converted or thermally decomposed.

3. The method of claim 1, wherein the vacuum residue treated in said vacuum distillation tower in step (c) produces a heavy vacuum gas oil having a deep cut point temperature of about TBP of 530° C.-620° C.

4. The method of claim 1 wherein the solid residue separation product does not require diluent for transporting in a pipeline resulting in economies in transporting said solid residue separation product.

5. The method of claim 1 wherein one or more fractions of the heavy feedstock is fed directly to intermediate refining units without requiring further separation and/or processing thereby improving the economies and value of the heavy feedstock fractions.

6. The method of claim 1, wherein the solid residue separation product is used as vacuum residue external feed for processing in refinery deep conversion units.

7. The method of claim 6, wherein the product form the vacuum residue processing unit is used as a supplement stream in deep conversion units to improve the refining economics and refinery fraction yields.

* * * * *